US006879296B2

(12) United States Patent
Jiang et al.

(10) Patent No.: US 6,879,296 B2
(45) Date of Patent: Apr. 12, 2005

(54) HORIZONTALLY POLARIZED SLOT ANTENNA WITH OMNI-DIRECTIONAL AND SECTORIAL RADIATION PATTERNS

(75) Inventors: Guozhong Jiang, Waterloo (CA); Xifan Chen, Kitchener (CA); Luke Zhu, Waterloo (CA)

(73) Assignee: Superpass Company Inc., Waterloo (CA)

( * ) Notice: Subject to any disclaimer, the term of this patent is extended or adjusted under 35 U.S.C. 154(b) by 0 days.

(21) Appl. No.: 10/301,819

(22) Filed: Nov. 21, 2002

(65) Prior Publication Data

US 2003/0184485 A1 Oct. 2, 2003

Related U.S. Application Data

(60) Provisional application No. 60/331,765, filed on Nov. 21, 2001.

(30) Foreign Application Priority Data

Nov. 21, 2001 (CA) ..... 2363519

(51) Int. Cl.[7] ..... H01Q 13/10
(52) U.S. Cl. ..... 343/767; 343/770
(58) Field of Search ..... 343/767, 770, 343/700 MS, 702, 768, 771; H01Q 13/10

(56) References Cited

U.S. PATENT DOCUMENTS

| | | | | |
|---|---|---|---|---|
| 4,197,545 A | | 4/1980 | Favaloro et al. | 343/700 |
| 4,367,475 A | | 1/1983 | Schiavone | 343/767 |
| 5,357,260 A | * | 10/1994 | Roederer et al. | 343/754 |
| 5,677,698 A | | 10/1997 | Snowdon | 343/770 |
| 6,031,503 A | | 2/2000 | Preiss, II et al. | 343/770 |
| 6,215,447 B1 | * | 4/2001 | Johnson | 343/702 |
| 6,307,520 B1 | | 10/2001 | Liu | 343/767 |
| 6,392,609 B2 | | 5/2002 | Nieminen | 343/767 |
| 6,414,642 B2 | | 7/2002 | Honda et al. | 343/702 |

* cited by examiner

*Primary Examiner*—Hoanganh Le
(74) *Attorney, Agent, or Firm*—Fasken Martineau DuMoulin LLP

(57) ABSTRACT

A slot antenna comprising: a first and second boards each having an edge attached to respective opposite edges of a center board to form an essentially C-shaped open-ended channel having an inner surface and an outer surface; the center board having a slot for radiating signals defined in an electrically conductive layer bonded to an outer surface thereof and an electrically conductive feed line bonded to an inner surface thereof; the slot having a drive point being a portion of the feed line undercrossing the slot between opposite edges of the slot; the first and second boards each having an electrically conductive layer bonded to an outer surface thereof to reduce nulls, thereby providing an essentially omni-directional radiation pattern for the slot; and, a connector for coupling the signals to the antenna.

41 Claims, 5 Drawing Sheets

HORIZONTALLY POLARIZED SLOT ANTENNA WITH OMNI-DIRECTIONAL AND SECTORIAL RADIATION PATTERNS

This application claims priority from U.S. patent application Ser. No. 60/331,765, filed Nov. 21, 2001, and Canadian Patent Application No. 2,363,519, filed Nov. 21, 2001 and incorporated herein by reference.

The invention relates to the field of slot antennas, and more specifically to horizontally polarized slot antennas for mobile communication systems, wireless LAN systems, and the like.

BACKGROUND OF THE INVENTION

There has been an increase in the use of horizontally polarized slot antennas for mobile communication systems. While directional horizontally polarized slot antennas are relatively easy to be design and manufacture, omni-directional and sectorial horizontally polarized slot antennas are more difficult to design and manufacture and hence are more expensive. This has an adverse effect on cost of establishing base stations for systems including mobile communication, wireless LAN (e.g. at 2.4 GHz and 5.8 GHz), UNII (Unlicensed National Information Infrastructure), MMDS (Multichannel Multipoint Distribution Service), and WLL (Wireless Local Loop) systems.

A need therefore exists for an improved horizonally polarized slot antenna capable of omni-directional and sectorial radiation patterns that can be manufactured cost effectively. Consequently, it is an object of the present invention to obviate or mitigate at least some of the above mentioned disadvantages.

SUMMARY OF THE INVENTION

According to one aspect of the invention there is provided a slot antenna comprising: first and second boards each having an edge attached to respective opposite edges of a center board to form an essentially C-shaped open-ended channel having an inner surface and an outer surface; the center board having a slot for radiating signals defined in an electrically conductive layer bonded to an outer surface thereof and an electrically conductive feed line bonded to an inner surface thereof; the slot having a drive point being a portion of the feed line undercrossing the slot between opposite edges of the slot; the first and second boards each having an electrically conductive layer bonded to an outer surface thereof to reduce nulls, thereby providing an essentially omni-directional radiation pattern for the slot; and, a connector for coupling the signals to the antenna.

According to another aspect of the invention the slot antenna includes a reflector having first and second panels each having an edge attached to respective opposite edges of a center panel to form an essentially C-shaped open-ended channel having an inner surface and an outer surface; the center panel having an outer surface spaced from and parallel to the inner surface of the center board to sectorialize the radiation pattern of the slot by approximately 180 degrees.

According to another aspect of the invention the slot antenna includes first and second reflector panels each spaced successively from and parallel to the inner surface of said center board to sectorialize the radiation pattern of the slot by approximately 120 degrees.

Advantageously, the present invention provides an improved horizonally polarized slot antenna for omni-directional and sectorial applications that can be manufactured cost effectively. Communication capacity may be almost doubled, without increasing interference, by using this slot antenna in mobile communications systems.

BRIEF DESCRIPTION OF THE DRAWINGS

Embodiments of the invention may best be understood by referring to the following description and accompanying drawings. In the description and drawings, like numerals refer to like structures and/or processes. In the drawings.

DETAILED DESCRIPTION OF THE PREFERRED EMBODIMENTS

In the following description, numerous specific details are set forth to provide a thorough understanding of the invention. However, it is understood that the invention may be practiced without these specific details. In other instances, well-known structures and/or processes have not been described or shown in detail in order not to obscure the invention. In the description and drawings, like numerals refer to like structures and/or processes.

In general, the invention described herein provides a slot antenna that includes a slot on the surface of a dielectric substrate, a feed network on the bottom of the substrate, and two pieces of parallel conductor panel located on each side of the slot. The slot antenna is horizontally polarized, omni-directional, and may be fitted with reflectors for sectorial applications. Communication capacity may be almost doubled, without increasing interference, by using this slot antenna in mobile communication systems.

Figures 1A, 1B:
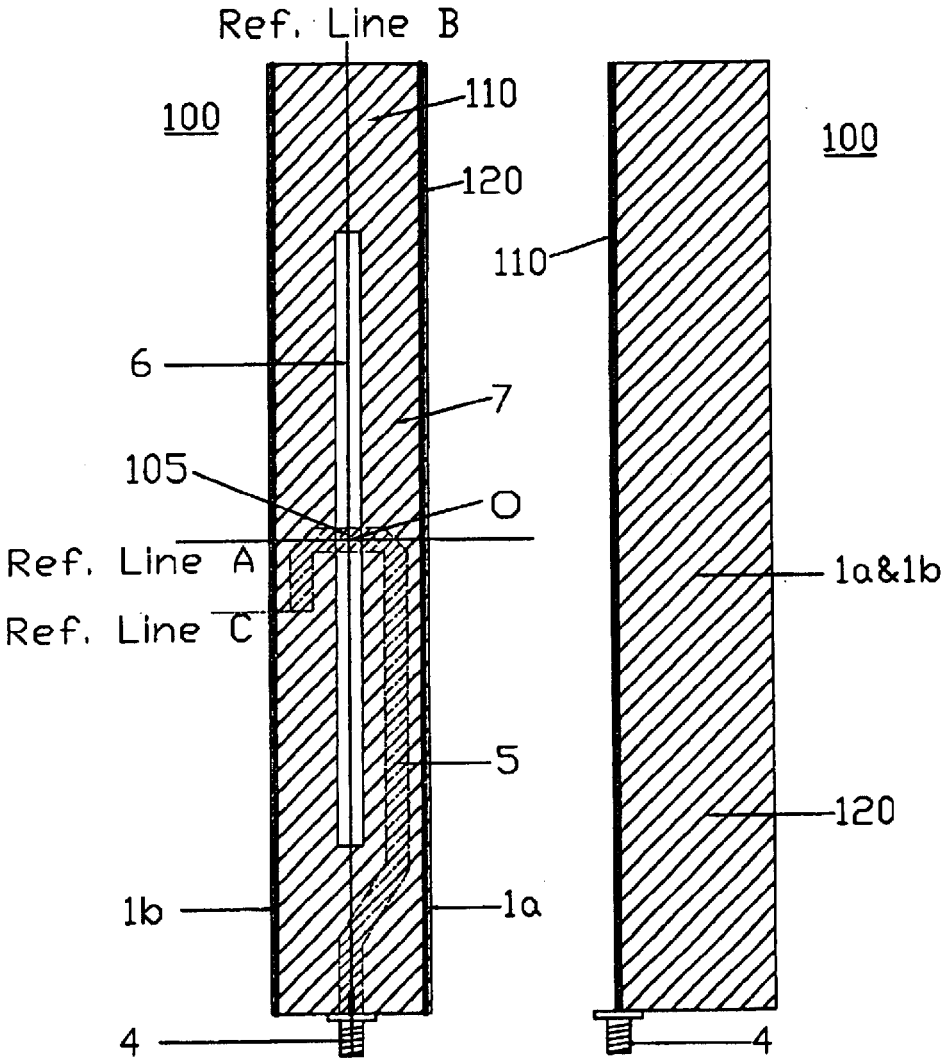
FIGS. 1(*a*), 1(*b*), and 1(*c*) are front, right-hand side, and bottom views, respectively, illustrating a single-element omni-directional slot antenna in accordance with an embodiment of the invention.
Figure 1C:
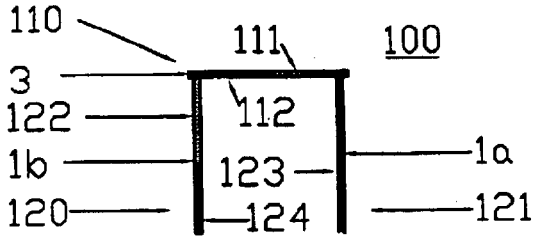

FIGS. 1(*a*), 1(*b*), and 1(*c*) are front, right-hand side, and bottom views, respectively, illustrating a single-element omni-directional slot antenna in accordance with an embodiment of the invention. In FIGS. 1(*a*), 1(*b*), and 1(*c*), the single-element slot antenna is shown generally by numeral 100. The slot antenna 100 is horizontal polarized and can be used to provide omni-directional and sectorial radiation patterns as will be described below. The slot antenna 100 includes two main assemblies. The first is a slot antenna assembly 110 which is fed by a microstrip line with a ground plane 111. The second is a conductor/PCB assembly 120 consisting of two pieces of conductor panel 121 and 122 which may be supported by dielectric material 123 and 124 respectively (which collectively, may, for example, be single sided PCB 1(*a*), 1(*b*). And the conductor assembly 120 is attached to the slot antenna assembly 110 mechanically, so that conductors 121 and 122 and ground plate 111 are held together but remain DC isolated from each other electrically. The slot antenna assembly 110 and the conductor/PCB assembly 120 define a single-element omni-directional slot antenna 100.

Theoretically, a slot antenna having an infinite ground plane may be considered as a magnetic dipole antenna. As such, its radiation pattern should be omni-directional. However, in practice, due to the limited size of its ground plane, there are typically two nulls at 90° and 270° in a slot antenna's horizontal radiation pattern. In order to eliminate these nulls, the present invention provides a PCB assemble 120, as shown in FIGS. 1(*a*), 1(*b*), and 1(*c*), that includes two pieces of single-sided PCB 1(*a*), 1(*b*) attached to opposite sides of the slot antenna assembly 110. By optimizing the size of the PCBs 1(*a*), 1(*b*), and the distance between them, an omni-directional radiation pattern is achieved in which the difference between the maximum and minimum radiation levels is less than 2 dB. Based on the single-element omni-directional slot antenna 100 of FIGS. 1(*a*), 1(*b*), and 1(*c*), two-element and four-element omni-directional antenna arrays are provided as described below. In addition, by adding metal reflectors behind the single-element omni-directional slot antenna 100 of FIGS. 1(*a*), 1(*b*), and 1(*c*), 180° and 120° sectorial slot antennas are provided as described below.

Again referring to FIGS. 1(*a*), 1(*b*), and 1(*c*), the slot antenna assembly 110 includes a rectangular, low-loss dielectric RF-35 (e.g. a ceramic filled, low cost PTFE substrate from Taconic) PCB 3 having thin copper sheets adhered to both sides 111, 112. Conductive segments 5, 7 are formed on the RF-35 PCB 3 by etching or milling. These conductive segments include a ground plane 7 formed on the front-side 111 of the RF-35 PCB 3 and a microstrip feed line 5 formed on the back-side 112 of the RF-35 PCB 3. A rectangular slot 6 for radiating radio frequency ("RF") signals is formed in the ground plane 7 by removing copper through an etching or milling process. The slot 6 may be centred in the ground plane 7 along the horizontal and vertical centre-lines (i.e. Ref. Line A and Ref. Line B in FIG. 1(*a*)) of the ground plane 7 or PCB 3. A 50-ohm connector 4 located along the bottom edge of the RF-35 PCB 3 couples RF signals to the slot antenna assembly 100 via the microstrip feed line 5 and the ground plane 7. Typically, the 50-ohm connector 4 is a coaxial cable having a conventional inner conductor, insulator, and an outer conductor or shield. The outer conductor is connected to the ground plane 7 and the inner conductor is connected to the feed line 5. A portion 105 of the feed line 5 crosses the slot 6 along the horizontal centre-line (i.e. Ref Line A in FIG. 1(*a*)) of the slot 6. This portion 105 of the feed line drives the slot 6. The midpoint O of this portion 105 of the feed line 105 may be considered the drive point O of the slot 6. In this embodiment, the drive point O lies at the centre of the slot, that is, at the crossing of the slot's horizontal and vertical centre-lines Ref. Line A, Ref Line B.

The PCB assembly 120 includes two pieces of rectangular, single-sided FR-4 (i.e. epoxy glass laminate substrate) PCB 1(*a*), 1(*b*) attached to opposite sides of the slot antenna assembly 110. Each FRA PCB 1(*a*), 1(*b*) includes a layer of copper on one side. Each FR-4 PCB 1(*a*), 1(*b*) is composed of one-ounce FR-4 material. Advantageously, performance is improved by locating the copper layer on the outer side 121, 122 of each FR-4 PCB 1(*a*), 1(*b*). The FR-4 PCBs 1(*a*), 1(*b*) are attached to opposite edges of the RF-35 PCB 3 by gluing. The FR-4 PCBs 1(*a*), 1(*b*) are generally parallel to each other and perpendicular to the RF-35 PCB 3.

It is known that for a conventional quarter-wavelength slot antenna, the input impedance at the feed point is approximately 500 ohms, which is difficult to match to a 50-ohm connector. According to an embodiment of the invention, a slot 6 approximately 88 mm in length (i.e. 0.715 wavelength) is used to lower the input impedance to approximately 200 ohms and to increase the gain of the slot 6 to approximately 3.5 dB.

In addition, the two FR-4 PCBs 1(*a*), 1(*b*) of the PCB assembly 120 provide several advantages. Firstly, by optimizing the design and spacing of the two FR-4 PCBs 1(*a*), 1(*b*), the input impedance of the slot antenna 100 is further reduced to approximately 70 ohms. This allows the slot antenna 100 to be more easily matched to the 50-ohm connector 4. Secondly, the two FR-4 PCBs 1(*a*), 1(*b*) function to remove the nulls at 90° and 270° in the horizontal radiation pattern of the slot antenna 100 so that an omni-directional radiation pattern can be achieved. Based on tests performed by the applicants, a difference between maximum and minimum radiation levels of less than 2 dB may be achieved with the slot antenna 100 of the present invention.

According to this embodiment of the invention, the width of the slot 6 is approximately 3.6 mm (i.e. 0.028 wavelength) at 2.4 GHz, which corresponds to a free-space wavelength at 2.4 GHz of approximately 123 mm. This width is wide enough to achieve an operational frequency bandwidth of 83 MHz (i.e. a frequency band from 2.4 to 2.483 GHz) and is also narrow enough to ensure a low cross-polarization radiation level of approximately −20 dB. In this embodiment, the length and width of the RF-35 PCB 3 are 140.8 mm and 23.4 mm, respectively. The length and width of each single-sided FR-4 PCB 1(*a*), 1(*b*) arc approximately 140.8 mm and 24 mm, respectively. And, the inner sides 123, 124 of the two single-sided FR-4 PCBs 1(*a*), 1(*b*) are spaced approximately 20.3 mm apart.

Figure 2:
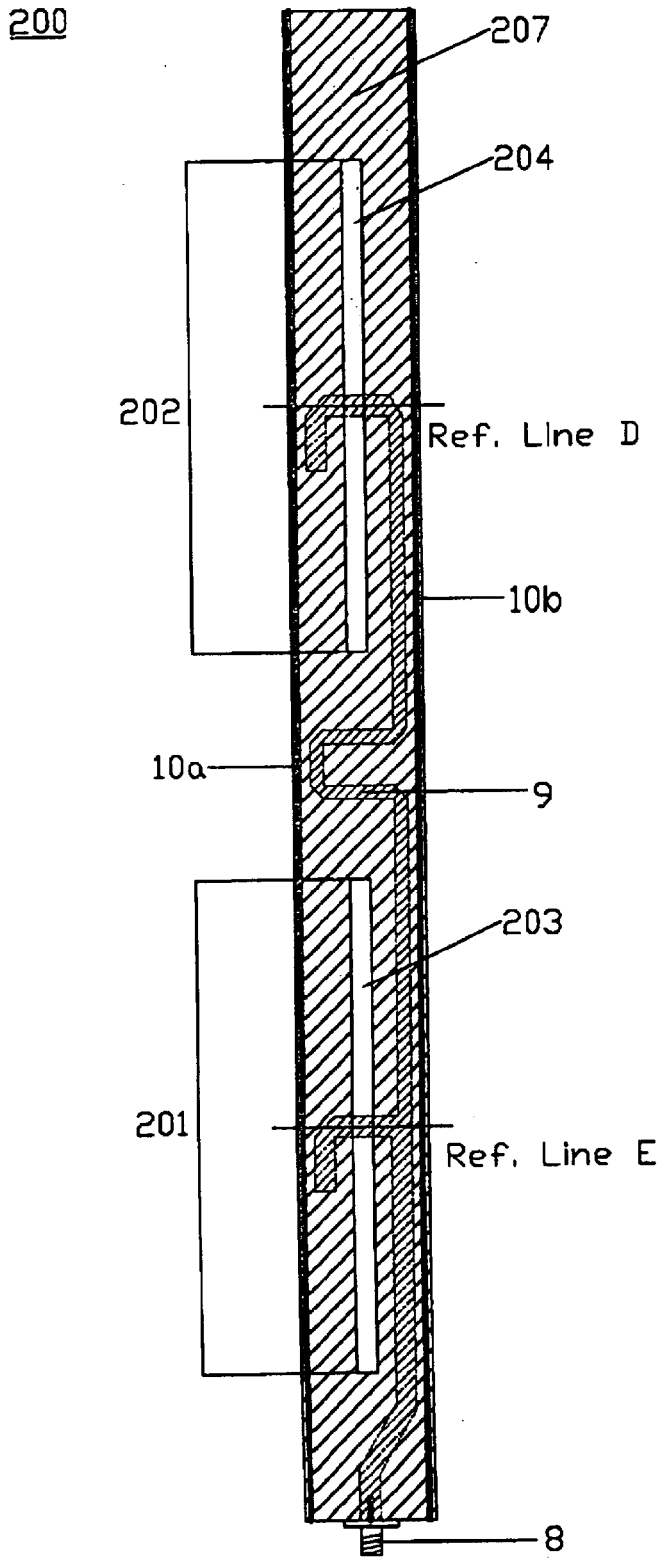
FIG. 2 is a front view illustrating a two-element omni-directional slot antenna in accordance with an embodiment of the invention.

FIG. 2 is a front view illustrating a two-element omni-directional slot antenna array 200 in accordance with an embodiment of the invention. The array 200 includes two slot antenna elements 201, 202 that are similar to the single-element slot antenna 100 of FIGS. 1(*a*), 1(*b*), and 1(*c*). A RF signal is delivered to or received from the first element 201 via a 50-ohm connector 8. A portion of the RF signal is further delivered to or received from the second element 202 though a microstrip line 9. From the connector 8 to Ref. Line E, the microstrip feed line 9 has a first common width. Between Ref. Line E and Ref. Line D, the microstrip feed line 9 has a second common width that is narrower that the first common width. According to one embodiment of the invention, the first and second common widths are approximately 3.6 mm and 2.4 mm, respectively. The width of the microstrip feed line 9 is designed to provide appropriate matching and phase shifting so that the RF signal delivered to both the first and second elements 201, 202 will have approximately the same amplitude and will be approximately in-phase. In this embodiment, the maximum antenna gain achieved is approximately 5.5 dBi. Note that the array 200 includes two continuous rectangular FR-4 PCBs 10(*a*), 10(*b*), a continuous rectangular ground plane 207, and two vertically-spaced rectangular slots 203, 204. At 2.4 GHz, the slotts 203, 204 are spaced vertically by approximately 129.6 mm (i.e. from Ref. Line D to Ref. Line E).

Figures 3A, 3B:
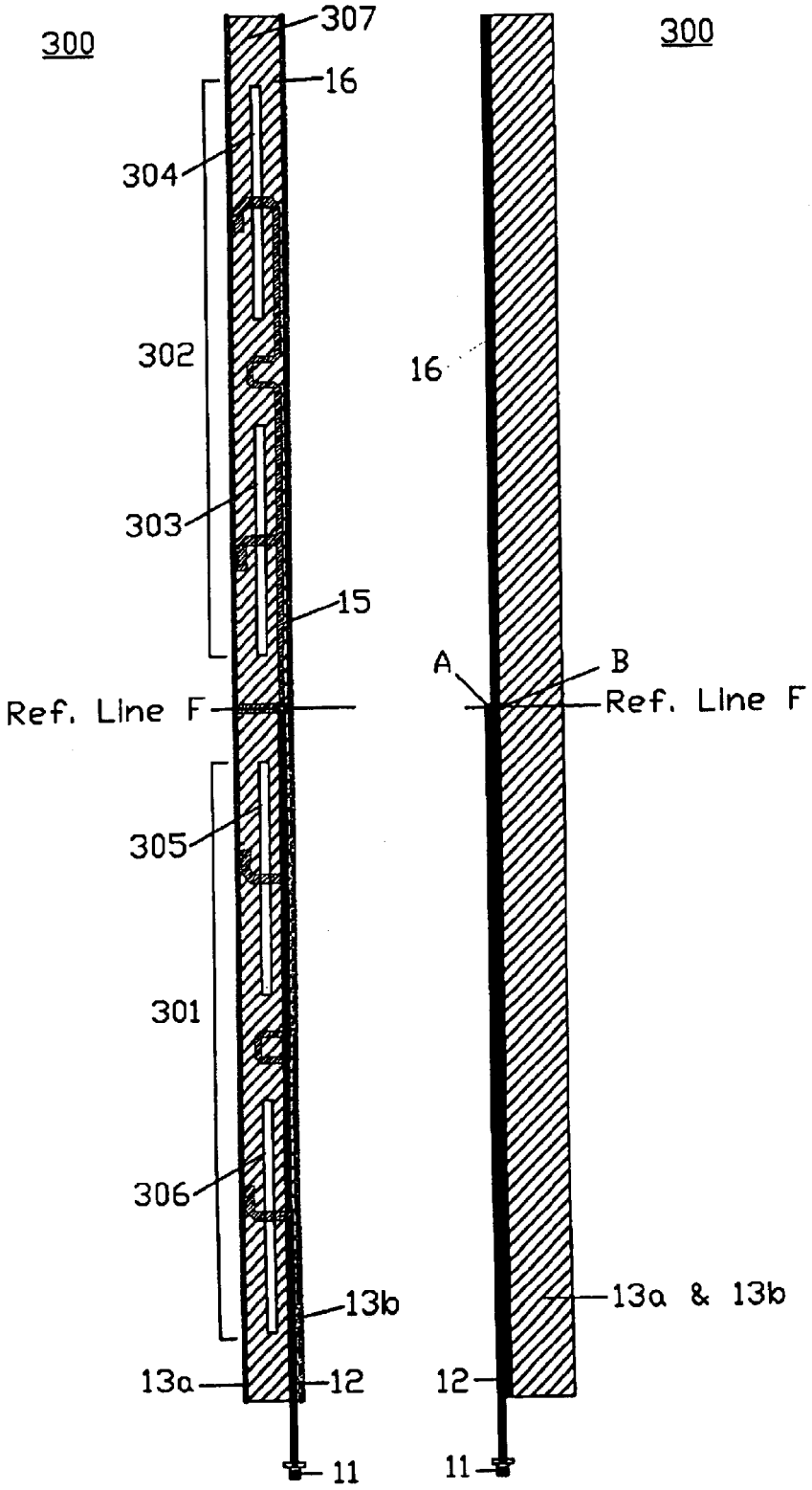
FIGS. 3(*a*) and 3(*b*) are front and right-hand side views, respectively, illustrating a centre-fed four-element omni-directional slot antenna array in accordance with an embodiment of the invention.

FIGS. 3(*a*) and 3(*b*) are front and right-hand side views, respectively, illustrating a centre-fed four-element omni-directional slot antenna array 300 in accordance with an embodiment of the invention. The array 300 includes two two-element slot antenna arrays 301, 302 that are similar to the two-element slot antenna array 200 of FIG. 2. The second two-element slot antenna array 302 is the mirror image of the first two-element slot antenna array 301 with respect to Ref. Line F. Both the first and second arrays 301, 302 share a common feed point B along Ref. Line F. The array 300 has a 50-ohm connector 11 that is connected to a 50-ohm low-loss semi-rigid cable 12. The cable 12 is terminated along Ref. Line F on the RF-35 PCB 16. The cable 12 may be a coaxial cable having a conventional inner conductor, insulator, and an outer conductor or shield. The outer conductor of the cable 12 is connected (e.g. soldered) to the ground plane 307 on the front-side of the RF-35 PCB 16. The inner conductor of the cable 12 is connected (i.e. soldered) to feed point B on the microstrip feed line 15 on the back-side of the RF-35 PCB 16. The inner conductor of the cable 12 passes through the RF-35 PCB 16 at point A along the horizontal centre-line Ref. Line F of the RF-35 PCB 16. Note that the array 300 includes two continuous rectangular FR-4 PCBs 13(*a*), 13(*b*), a continuous rectangular ground plane 307, and four vertically-spaced rectangular slots 303, 304, 305, 306.

In operation, a RF signal is fed into the 50-ohm connector 11. The signal travels through the 50-ohm low-loss semi-rigid cable 12 to the feed point B along Ref. Line F. This coaxial cable-to-printed microstrip food line transition provides an effective 50-ohm match for the RP signal. The signal is then equally distributed between the first and second arrays 301, 302. That is, half of the signal energy will be distributed to the first array 301 via that portion of the stripline extending downward from Ret. Line F and half of the signal energy will be distrbuted ot the second array 302 via that portion of the stripline extending upward from Ref. Line F. Therefore, both the first and second arrays 301, 302 are fed with signals of approximately the same amplitude and phase. The cable 12 attached to the microstrip feed line 15 has little effect on the radiation pattern. Thus, the four-element slot antenna array 300 provides an effective omni-directional radiation pattern.

Figure 4A:
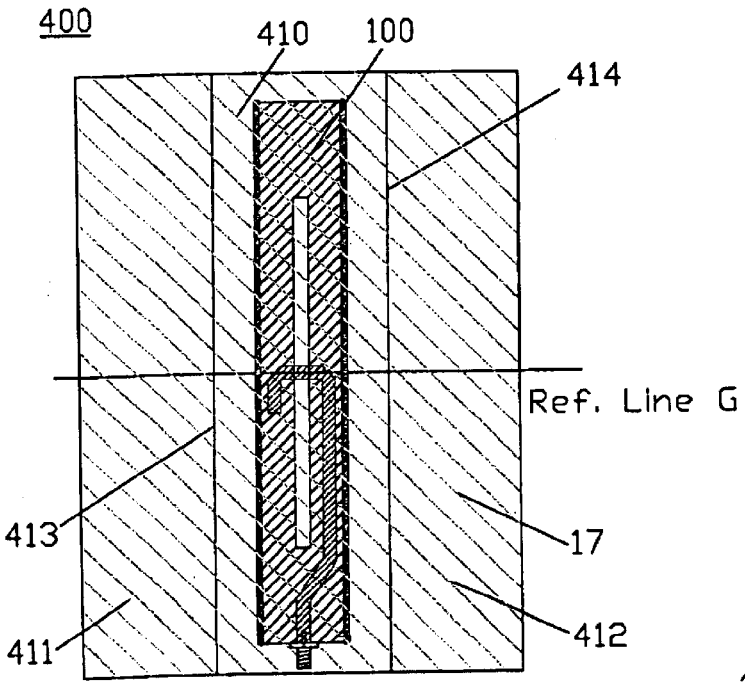
FIGS. 4(*a*), 4(*b*), and 4(*c*) are front, right-hand side, and bottom views, respectively, illustrating a single-element 180 degree sectorial slot antenna in accordance with an embodiment of the invention; and, FIGS. 5(*a*), 5(*b*), and 5(*c*) are front, right-hand side, and bottom views, respectively, illustrating a single-element 120 degree sectorial slot antenna in accordance with an embodiment of the invention.
Figure 4B:
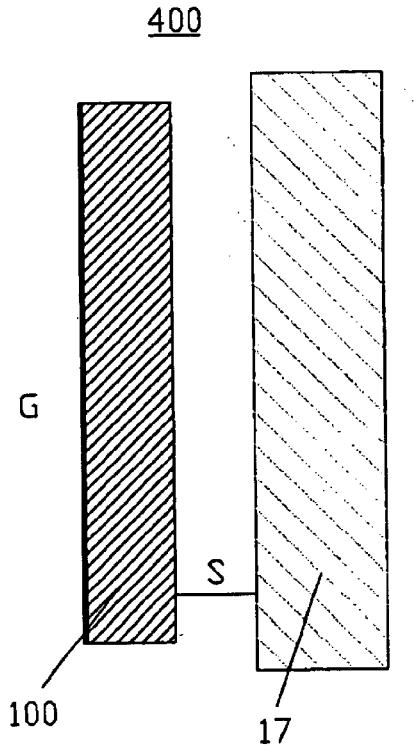
Figure 4C:
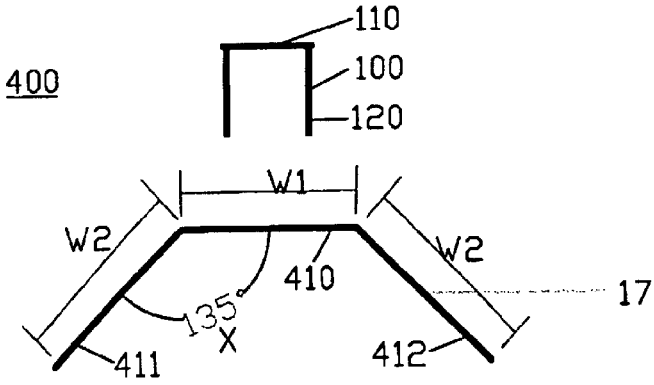

FIGS. 4(*a*), 4(*b*), and 4(*c*) are front, right-hand side, and bottom views, respectively, illustrating a single-element 180 degree sectorial slot antenna 400 in accordance with an embodiment of the invention. The 180 degree sectorial slot antenna 400 includes the single-element omni-directional slot antenna 100 of FIGS. 1(*a*), 1(*b*), and 1(*c*). In addition, the 180 degree sectorial slot antenna 400 includes a bent metal reflector assembly 17. The reflector 17 includes a rectangular centre panel 410, a first rectangular side panel 411 joined to one vertical edge 413 of the centre panel 410, and a second rectangular side panel 412 joined to the opposite vertical edge 414 of the centre panel 410. According to this embodiment, the width W1 of the centre panel 410 is approximately 70 mm. The width W2 of each side panel 411, 412 is approximately 70 mm. The angle X between the plane defined by the centre panel 410 and the planes defined by each of the side panels 411, 412 is approximately 135 degrees. The reflector 17 is mounted behind the single-clement slot antenna 100 such that the planes defined by the centre panel 410 and the slot antenna assembly 110 are parallel. The mounting of the reflector 17 may be accomplished in several ways. The slot antenna 100 and reflector 17 may be mounted in a common enclosure or radome. Or, the slot antenna 100 may be mounted in an enclosure or radome and the reflector 17 may be attached to this enclosure by screws and spacers, for example. In this embodiment, the spacing S between the reflector 17 and the single-element slot antenna 100 is approximately 32 mm. The single-element slot antenna 100 is centred along the horizontal centre-line Ref. Line G of the centre panel 410 of the reflector 17. In general, the length and width of the centre panel 410 of the reflector 17 are greater than the length and width of the slot antenna assembly 110 of the single-element slot antenna 100.

The reflector 17 provides electromagnetic reflection for the slot antenna 100 such that a horizontal beamwidth of approximately 180 degrees is achieved. Hence, the antenna 400 is referred to as a 180 degree sectorial slot antenna. At 2.4 GHz, a horizontal beamwidth of approximately 180 degrees is achieved with a spacing S of approximately 32 mm between the reflector 17 and the slot antenna 100, an angle X of approximately 135 degrees between the centre panel 410 and each side panel 411, 412 of the reflector, and centre and side panel widths W1, W2 of approximately 70 mm each. By modifying the spacing S between the reflector 17 and the slot antenna 100, the angle X between the centre panel 410 and side panels 411, 412 of the reflector 17, and/or the width W1, W2 of each reflector panel 410, 411, 412, different sectorial ranges can be achieved. These modifications affect the electromagnetic field distribution and hence the horizontal beamwidth of the antenna 400. According to another embodiment of the invention, the widths W1, W2 of the centre and side panels 410, 411, 412 are set to approximately 52 mm and 48 mm, respectively.

Figure 5A:
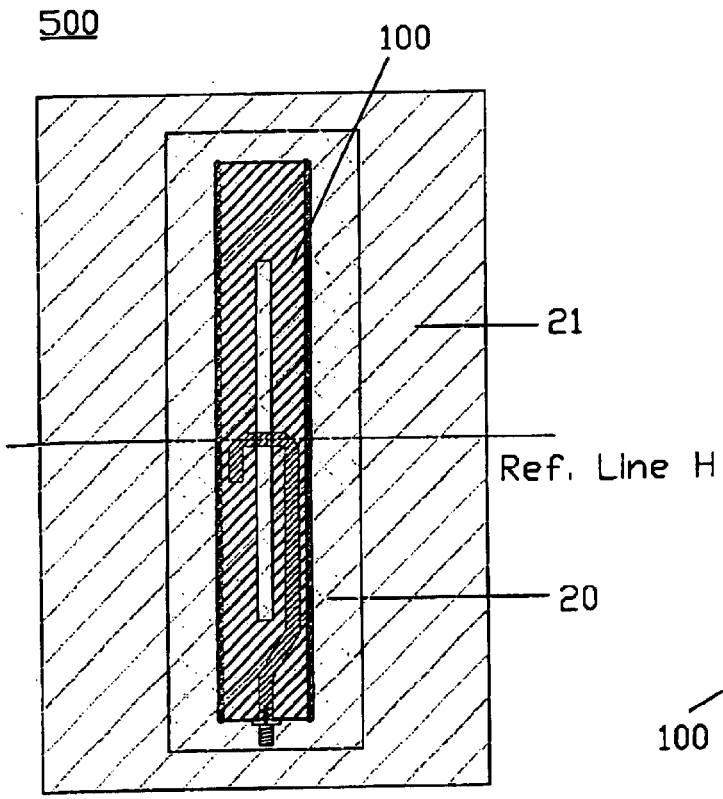
Figure 5B:
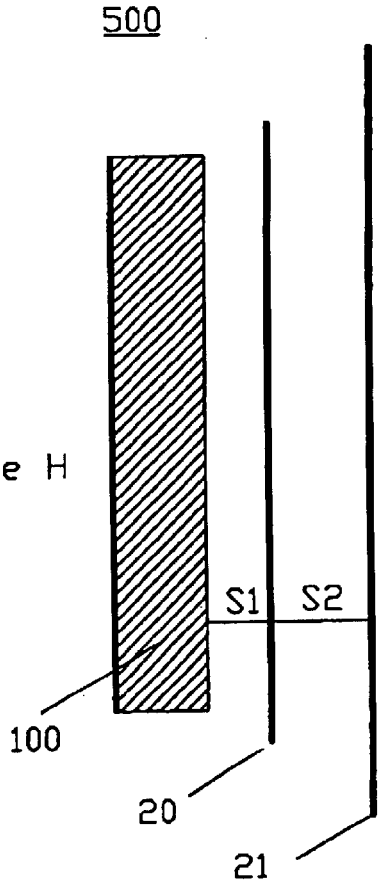
Figure 5C:
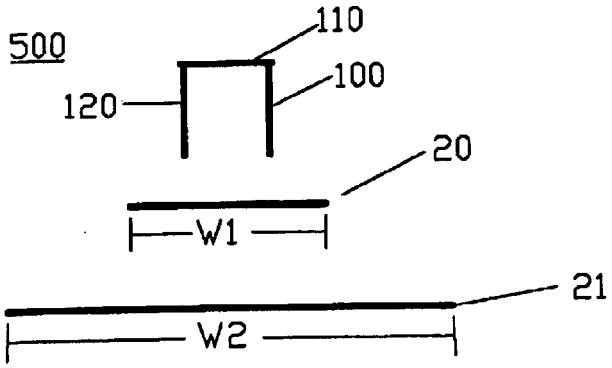

FIGS. 5(*a*), 5(*b*), and 5(*c*) are front, right-hand side, and bottom views, respectively, illustrating a single-element 120 degree sectorial slot antenna 500 in accordance with an embodiment of the invention. The 120 degree sectorial slot antenna 500 includes the single-element omni-directional slot antenna 100 of FIGS. 1(*a*), 1(*b*), and 1(*c*). In addition, the 120 degree sectorial slot antenna 500 includes first and second flat rectangular metal reflectors 20, 21. The width W3 of the first reflector 20 is approximately 51 mm. The width W4 of the second reflector 21 is approximately 106 mm. The first reflector 20 is mounted behind the single-element slot antenna 100 such that the planes defined by the first reflector 20 and the slot antenna assembly 110 are parallel. The second reflector 21 is mounted behind the first reflector 20 such that the planes defined by each reflector 20, 21 are parallel. The mounting of the reflectors 20, 21 may be accomplished in several ways. The slot antenna 100 and reflectors 20, 21 may be mounted in a common enclosure or radome. Or, the slot antenna 100 may be mounted in an enclosure or radome and the reflectors 20, 21 may be attached to this enclosure by screws and spacers, for example. In this embodiment, the spacing S1 between the first reflector 20 and the single-element slot antenna 100 is approximately 12.7 mm. The spacing S2 between the first reflector 20 and the second reflector 21 is approximately 19.1 mm. The single-element slot antenna 100 is centred along the horizontal centre-line Ref. Line H of the first reflector 20. The first reflector 20 is centred along the horizontal centre-line Ref. Line H of the second reflector 21. In general, the length and width of the first reflector 20 are greater than the length and width of the slot antenna assembly 110 of the single-element slot antenna 100. And, the length and width of the second reflector 21 are greater than the length and width of the first reflector 20.

The reflectors 20, 21 provide electromagnetic reflection for the slot antenna 100 such that a horizontal beamwidth of approximately 120 degrees is achieved. Hence, the antenna 500 is referred to as a 120 degree sectorial slot antenna. At 2.4 GHz, a horizontal beamwidth of approximately 120 degrees is achieved with spacings S1, S2 between the reflectors 20, 21 and the slot antenna 100 of approximately 12.7 mm and 19.1 mm, respectively, and reflector panel widths W3, W4 of approximately 51 mm and 106 mm, respectively. By modifying the spacings S1, S2 between the reflectors 20, 21 and the slot antenna 100, and/or the widths W3, W4 of each reflector 20, 21, different sectorial ranges can be achieved. These modifications affect the electromagnetic field distribution and hence the horizontal beamwidth of the antenna 400. In general, the beamwidth of the antenna 500 will be narrowed by increasing the width W3 of the first reflector 20 while keeping the width W4 of the second reflector 21 constant. The beamwidth of the antenna 500 will be widened by increasing the width W4 of the second reflector 21 while keeping the width W3 of the first reflector 20 constant. Experiments conducted by the applicant have found that, in general, the beamwidth is affected more by varying the width W3 of the first reflector 20 than by varying the width W4 of the second reflector 21. According to another embodiment of the invention, the spacings S1, S2 between the reflectors 20, 21 and the slot antenna 100 are set to approximately 16 mm and 32 mm, respectively, and the reflector panel widths W3, W4 are set to approximately 48 min and 52 mm, respectively.

To reiterate and expand, the present invention provides a slot antenna having a slot that is optimized for maximum gain and improved cross-polarization performance. The slot length is approximately 73% of the desired wavelength and the width is approximately 3% of the desired wavelength. The slot antenna includes two conductive sheets (i.e. single-sided FR-4 PCBs) mounted on each side of the slot, and symmetric with respect to the slot, which provide an omni-directional radiation pattern for the antenna by removing the nulls at 90° and 270° that are due to limited ground plane size. In addition, the invention provides a series-fed two-element antenna array and a coaxial cable-to-microstrip transition parallel-fed four-element antenna array. Furthermore, by adding a bent metal reflector behind the slot antenna, the invention provides a sectorial antenna with approximately 180 degree beamwidth shaping. Moreover, by adding two flat meter reflectors behind the slot antenna, the invention provides a sectorial antenna with approximately 120 degree beamwidth shaping.

Although preferred embodiments of the invention have been described herein, it will be understood by those skilled in the art that variations may be made thereto without departing from the spirit of the invention or the scope of the appended claims.

The embodiments of the invention in which an exclusive property or privilege is claimed are defined as follows:

1. A slot antenna comprising:

a center board having an inner surface and an outer surface;

first and second boards each having an edge attached to respective opposite edges of said inner surface of said center board to form an essentially C-shaped open-ended channel, said first and second boards being electrically insulated from said center board, said first and second boards each having an electrically conductive layer to reduce radiation nulls; and said center board having a slot for radiating signals defined in an electrically conductive layer bonded to said outer surface thereof and an electrically conductive feed line bonded to said inner surface thereof; said slot having a drive point defined by a portion of the feed line undercrossing said slot between opposite edges of said slot; and a connector for coupling said signals to said slot antenna;

wherein when in operation said slot antenna has an approximately omni-directional radiation pattern.

2. The slot antenna of claim 1 wherein said first, second and center boards are printed circuit boards (PCBs).

3. The slot antenna of claim 2 wherein each of said first, second and center boards comprises a conductor attached to a low-loss dielectric material.

4. The slot antenna of claim 3 wherein said slot and said first, second, and center boards have respective rectangular shapes.

5. A slot antenna of claim 4, wherein said low loss dielectric material of said first and second boards is comprised of an epoxy glass laminate substrate.

6. A slot antenna of claim 5, wherein said low loss dielectric material of said center board is composed of ceramic filled polytetrafluroethylene substrate.

7. The slot antenna of claim 4 wherein said opposite edges of said slot and said center board are long edges of said respective rectangular shapes.

8. The slot antenna of claim 7 wherein said slot is centered within said center board.

9. The slot antenna of claim 8 wherein said opposite edges of said slot are essentially parallel to said opposite edges of said center board.

10. The slot antenna of claim 9 wherein said center board forms an essentially right angle with each of said first and second boards.

11. The slot antenna of claim 10 wherein said slot has a length $L \cong 88$ mm, a width $W \cong 3.6$ mm, a wavelength $\lambda \cong 123$ mm, and a frequency $f \cong 2.4$ GHz, wherein $L \cong 0.715\lambda$ and $W \cong 0.028\lambda$.

12. The slot antenna of claim 11 wherein said first, second, and center boards have lengths L1, L2, and L3, and widths of W1, W2, and W3, respectively, and wherein $L1=L2=L3 \cong 140.8$ mm, $W1 \cong 23.4$ mm, and $W2=W3 \cong 24$ mm.

13. The slot antenna of claim 1 wherein said connector includes first and second conductors connected to said feed line and said conductive layer of said center board, respectively.

14. The slot antenna of claim 13 wherein said connector is a coaxial connector.

15. The slot antenna of claim 14 wherein said connector has an input impedance of approximately 50 ohms.

16. The slot antenna of claim 1 wherein said slot and said feed line are formed by etching.

17. The slot antenna of claim 1 wherein said channel is oriented vertically to provide a horizontally polarized radiation pattern.

18. The slot antenna of claim 1 wherein said channel is oriented horizontally to provide a vertically polarized radiation pattern.

19. The slot antenna of claim 1 for receiving said signals.

20. The slot antenna of claim 1 and further comprising:

a reflector having first and second panels each having an edge attached to respective opposite edges of a center panel to form an essentially C-shaped open-ended channel having an inner surface and an outer surface; said center panel having an outer surface spaced from and parallel to said inner surface of said center board to sectorialize said radiation pattern of said slot.

21. The slot antenna of claim 20 wherein said first, second, and center panels of said reflector have respective rectangular shapes.

22. The slot antenna of claim 21 wherein said opposite edges of said center panel are long edges of said center panel.

23. The slot antenna of claim 22 wherein said long edges of said center panel are parallel to said long edges of said center board.

24. The slot antenna of claim 23 wherein said center board is centered over said center panel.

25. The slot antenna of claim 24 wherein said reflector is formed from a sheet of metal by bending.

26. The slot antenna of claim 25 wherein said center panel forms an angle of approximately 135 degrees with each of said first and second panels.

27. The slot antenna of claim 26 wherein said first, second, and center panels have lengths L4, L5, and L6, and widths of W4, W5, and W6, respectively, and wherein L4=L5=L6≧140.8 mm and W4=W5=W6≅70 mm.

28. The slot antenna of claim 27 wherein said center panel is spaced a distance S from said inner surface of said center board and wherein W2 is the width of the side panel, wherein S≅W2+32 mm≅56 mm.

29. The slot antenna of claim 28 wherein said radiation pattern is sectorialized by approximately 180 degrees.

30. The slot antenna of claim 1 and further comprising:

first and second reflector panels each spaced successively from and parallel to said inner surface of said center board to sectorialize said radiation pattern of said slot.

31. The slot antenna of claim 30 wherein said first and second reflector panels have respective rectangular shapes.

32. The slot antenna of claim 31 wherein respective long edges of said first and second reflector panels are parallel to said long edges of said center board.

33. The slot antenna of claim 32 wherein said center board is centered over said first reflector panel and said first reflector panel is centered over said second reflector panel.

34. The slot antenna of claim 33 wherein said first and second reflector panels are metal panels.

35. The slot antenna of claim 34 wherein said first and second reflector panels have lengths L7 and L8, and widths W7 and W8, respectively, and wherein L8≧L7≧140.8 mm, approximately, W7≅51 mm, and W8≅106 mm.

36. The slot antenna of claim 35 wherein said first reflector panel is spaced a distance S1 from said inner surface of said center board and wherein W2 is the width of the side panel, wherein S1≅W2+12.7 mm≅44.7 mm.

37. The slot antenna of claim 36 wherein said second reflector panel is spaced a distance S2 from said first reflector panel and wherein S2≅19.1 mm.

38. The slot antenna of claim 37 wherein said radiation pattern is sectorialized by approximately 120 degrees.

39. The slot antenna of claim 30 wherein the spacing between said first reflector panel and said second reflector panel is approximately a fraction of the wavelength of the incoming electromagnetic waves.

40. A slot antenna comprising:

a center conductor, said center conductor being supported on a dielectric material and having a slot for radiating signals; said slot having a drive point defined by a portion of said feed line undercrossing said slot between opposite edges of said slot, a first conductor and a second conductor attached to said center conductor, said first and second conductors being electrically insulated from said center conductor, said first conductor and said second conductor being positioned to reduce radiation nulls of said slot antenna;

when in operation said slot antenna having an approximately omni-directional radiation pattern.

41. A slot antenna comprising:

a center board having an inner surface and an outer surface, said center board having a slot for radiating signals defined in an electrically conductive layer bonded to said outer surface thereof and an electrically conductive feed line bonded to said inner surface thereof; said slot having a drive point defined by a portion of said feed line undercrossing said slot between opposite edges of said slot;

first and second boards each having an edge attached to respective opposite edges of said center board to form an essentially C-shaped open-ended channel, said first and second boards each having an electrically conductive layer bonded to an outer surface thereof to reduce radiation nulls, thereby providing an essentially omni-directional radiation pattern for said slot;

a reflector having first and second panels each having an edge attached to respective opposite edges of a center panel to form an essentially C-shaped open-ended channel; said center panel having an outer surface spaced from and parallel to said inner surface of said center board to sectorialize said radiation pattern of said slot; and a connector for coupling said signals to said slot antenna.

* * * * *